US011486683B2

(12) United States Patent
Cziglenyi

(10) Patent No.: US 11,486,683 B2
(45) Date of Patent: Nov. 1, 2022

(54) ANGLED DUAL IMPACT BULLET

(71) Applicant: Joseph Cziglenyi, Nikolaevsk, AK (US)

(72) Inventor: Joseph Cziglenyi, Nikolaevsk, AK (US)

( * ) Notice: Subject to any disclaimer, the term of this patent is extended or adjusted under 35 U.S.C. 154(b) by 0 days.

(21) Appl. No.: 17/223,606

(22) Filed: Apr. 6, 2021

(65) Prior Publication Data

US 2022/0316846 A1 Oct. 6, 2022

(51) Int. Cl.
*F42B 12/34* (2006.01)
*F42B 12/36* (2006.01)

(52) U.S. Cl.
CPC ..... *F42B 12/367* (2013.01); *F42B 12/34* (2013.01)

(58) Field of Classification Search
CPC ..... F42B 12/34; F42B 12/367; F42B 12/78; F42B 12/00; F42B 12/02; F42B 12/36; F42B 12/76
USPC ..... 102/507–510, 516, 517
See application file for complete search history.

(56) References Cited

U.S. PATENT DOCUMENTS 1,062,865 A * 5/1913 Uhl ..... F42B 12/34 102/509
1,080,976 A * 12/1913 Johnson ..... F42B 12/34 102/507
1,967,416 A * 7/1934 Emil ..... F42B 12/78 102/507
3,003,420 A * 10/1961 Nosler ..... F42B 12/34 102/508
3,055,100 A * 9/1962 Kimpel ..... F16B 17/004 29/520
3,142,256 A * 7/1964 Mack ..... F42B 12/78 102/514
4,083,306 A 4/1978 Woodring
4,336,756 A * 6/1982 Schreiber ..... F42B 12/78 102/516
4,538,520 A 9/1985 Schmitz
4,750,427 A 6/1988 Carter
4,779,535 A 10/1988 Maki
4,958,570 A 9/1990 Harris
5,097,767 A 3/1992 Cirillo
5,099,765 A 3/1992 Czetto, Jr.
5,149,913 A 9/1992 Arakaki
5,385,101 A 1/1995 Corzine et al.
5,476,045 A 12/1995 Chung et al.
6,244,187 B1 6/2001 Head
6,439,125 B1 8/2002 Carter
6,561,070 B2 5/2003 Weber
6,598,536 B2 * 7/2003 Burri ..... F42B 12/367 102/517

(Continued)

FOREIGN PATENT DOCUMENTS

DE 2223212 A1 * 11/1973 ..... F42B 12/34
GB 191300326 A * 1/1914 ..... F42B 12/78

*Primary Examiner* — James S Bergin
(74) *Attorney, Agent, or Firm* — Cionca IP Law P.C.; Marin Cionca

(57) ABSTRACT

A bullet having a front unit and a rear unit, the front unit adapted to house the rear unit is provided. The front unit has a fragmented section, a cavity wall section, and a separation ring. The separation ring being angled forward or rearward with respect to the center of the bullet or with respect to the outermost edge of the bullet and being disposed on the front unit between the fragmented section and the cavity wall section.

18 Claims, 6 Drawing Sheets

(56) References Cited

U.S. PATENT DOCUMENTS

| | | | | |
|---|---|---|---|---|
| 6,776,101 | B1 | 8/2004 | Pickard | |
| 6,792,869 | B2 | 9/2004 | Pi | |
| 6,805,057 | B2 | 10/2004 | Carr et al. | |
| 6,837,165 | B2 | 1/2005 | Eberhart et al. | |
| 6,845,717 | B1 | 1/2005 | Sauvestre | |
| 6,964,232 | B2 | 11/2005 | Eberhart et al. | |
| 7,210,412 | B2 | 5/2007 | O'Dwyer | |
| 7,299,750 | B2 * | 11/2007 | Schikora | F42B 12/34 102/506 |
| 7,503,260 | B2 | 3/2009 | Kapeles | |
| 7,543,535 | B2 * | 6/2009 | Herrlinger | F42B 12/78 102/516 |
| 8,307,768 | B2 | 11/2012 | Cziglenyi | |
| 9,200,878 | B2 | 12/2015 | Seecamp | |
| 9,970,739 | B2 * | 5/2018 | Muster | F42B 8/14 |
| 10,393,487 | B2 * | 8/2019 | Riess | F42B 12/06 |
| 2010/0224093 | A1 * | 9/2010 | Wilhelm | F42B 12/74 102/507 |
| 2014/0261044 | A1 | 9/2014 | Seecamp | |
| 2020/0166317 | A1 * | 5/2020 | Stenzel | F42B 12/34 |

* cited by examiner

ANGLED DUAL IMPACT BULLET

CROSS-REFERENCE TO RELATED APPLICATIONS

This application is related to U.S. Non-Provisional application Ser. No. 11/709,510 filed Feb. 21, 2007, which is now U.S. Pat. No. 8,307,768, which is hereby incorporated by reference, to the extent that it is not conflicting with the present application.

BACKGROUND OF INVENTION

1. Field of the Invention

The invention relates generally to projectiles and more specifically to a multi-function projectile which can reliably achieve a timely, controlled separation.

2. Description of the Related Art

One of the most important characteristics to consider regarding multi-function projectiles, both single unit and multi-unit, is the timely, controlled separation between fragments and the rear portion of the bullet. A multi-function bullet which achieves a timely, controlled separation can be of great use in, for example but not limited to, wildlife harvest. Traditional bullets and slow-separating multi-function bullets fail to regularly deliver enough trauma and hydro shock to quickly, humanely, and permanently incapacitate an animal.

If the bullet fragments do not separate from the rear portion quickly enough, such as within 0.001 second, the rear unit will drag the fragments deep into the target. A slow separation results in a non-explosive impact wherein the rear portion of the bullet loses significant energy and is unable to deeply penetrate a target. Current examples of multi-function bullets fail to achieve a timely controlled separation. For example, in a gelatin block test administered by Swedish Norma for their multiple function bullet, Kalahari, clearly showed the fragments failed to separate from the rear side. The bullet deformed similar to traditional bullet expansion.

Additionally, the post evaluation of the Dual Impact Bullet (DIB), originally named "Projectiles and Methods for Forming Projectiles," found that the bullet achieved a relatively slow fragment separation, resulting in no explosive impact deep penetration of the rear portion of the bullet.

Therefore, there is a need to solve the problems described above by proving a new bullet, which is a multi-function projectile and reliably achieves a timely, controlled separation between the fragments and rear portion of the bullet, and to do large open trauma on the surface of the animal.

The aspects or the problems and the associated solutions presented in this section could be or could have been pursued; they are not necessarily approaches that have been previously conceived or pursued. Therefore, unless otherwise indicated, it should not be assumed that any of the approaches presented in this section qualify as prior art merely by virtue of their presence in this section of the application.

BRIEF INVENTION SUMMARY

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

In an aspect, a multi-function bullet, the Angled Dual Impact Bullet (ADIB, projectile), is provided having a front unit and a separate and discrete rear unit. The front unit may have a u-shaped separation ring, disposed between the front section and rear section of the front unit.

In another aspect, a multi-function bullet, the Angled Dual Impact Bullet (ADIB, projectile), is provided having the u-shaped separation ring angled forward or rearward with respect to the center of the bullet or outermost edge of the bullet. In another aspect, the separation ring has a continuous configuration from the fragmented portion of the front unit to the rear section of the front unit. With the u-shaped separation ring, which is angled, the ADIB can reliably provide and timely, controlled separation between the fragments and the rear unit of the bullet. Thus, an advantage is the controlled separation between the fragments.

In another aspect, the u-shaped separation ring is disposed at the transition between the front unit and a rear unit. In another aspect, the u-shaped separation ring has an outside diameter which is equal to the outside diameter of the bullet and an inside diameter which corresponds to the diameter of an interior portion of the rear unit where the interior portion starts at a shelf, as disclosed in greater detail hereinafter. Thus, an advantage is the reliable and timely separation of the fragments.

As an example, the ADIB can be manufactured by: (1) manufacturing the front unit with a crumpled section, disposed between the rear portion of the front unit and the cavity wall; (2) manufacturing the rear unit with a complimentary configuration to the front unit, such that the portions of the rear unit fit snugly into the front unit; (3) inserting the rear unit into the front unit; and (4) pressing the rear unit and front unit together until a crumpled section is compressed and forms a u-shaped separation ring. It should be noted that no bullet jacket in needed to assemble the projectile in this exemplary embodiment of an ADIB. Thus, with the u-shaped separation ring, which is angled, the ADIB can reliably provide and timely, controlled separation between the fragments and the rear unit of the bullet.

The above aspects or examples and advantages, as well as other aspects or examples and advantages, will become apparent from the ensuing description and accompanying drawings.

BRIEF DESCRIPTION OF THE DRAWINGS

For exemplification purposes, and not for limitation purposes, aspects, embodiments or examples of the invention are illustrated in the figures of the accompanying drawings, in which.

DETAILED DESCRIPTION

Figure 1A:
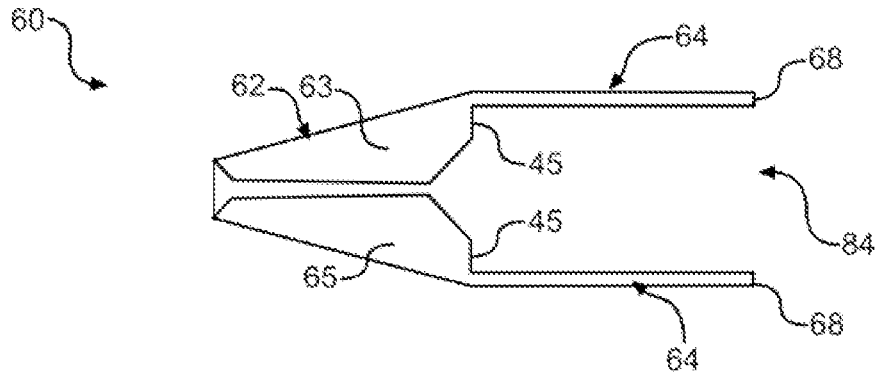
FIGS. 1A-C illustrate horizontal cross-sectional views of exemplary embodiments of an Angled Dual Impact Bullet (ADIB, projectile), according to an aspect.

What follows is a description of various aspects, embodiments and/or examples in which the invention may be practiced. Reference will be made to the attached drawings, and the information included in the drawings is part of this detailed description. The aspects, embodiments and/or examples described herein are presented for exemplification purposes, and not for limitation purposes. It should be understood that structural and/or logical modifications could be made by someone of ordinary skills in the art without departing from the scope of the invention. Therefore, the scope of the invention is defined by the accompanying claims and their equivalents.

It should be understood that, for clarity of the drawings and of the specification, some or all details about some structural components or steps that are known in the art are not shown or described if they are not necessary for the invention to be understood by one of ordinary skills in the art.

If there is a difference between correspondingly labeled elements that is not pointed out, and this difference results in a non-corresponding structure or function of an element for a particular embodiment, example or aspect, then the conflicting description given for that particular embodiment, example or aspect shall govern.

Figure 1B:
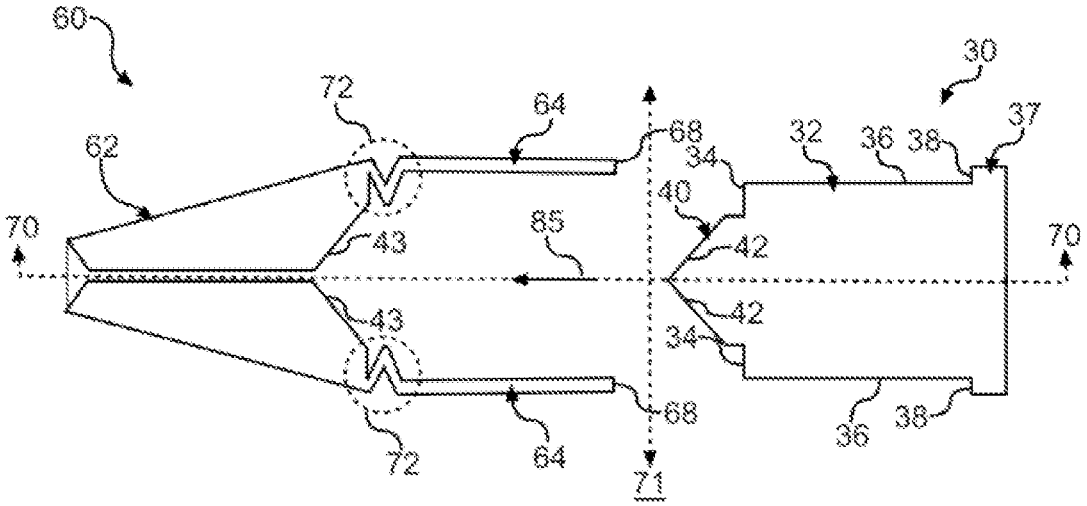
Figure 1C:
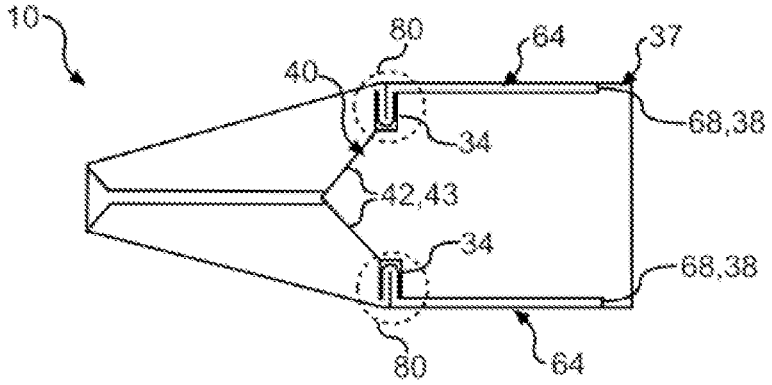

FIGS. 1A-C illustrate horizontal cross-sectional views of exemplary embodiments of an Angled Dual Impact Bullet ("ADIB," "projectile") 10, according to an aspect. It should be noted that the ADIB is shown without a bullet jacket for clarity. An exemplary ADIB 10 may comprise a rear unit ("first unit") 30 configured to be secured with or secured into a front unit ("second unit") 60 along a horizontal axis shown by sectional line 70-70. As disclosed herein, the rear unit 30 may be configured such that the rear unit 30 stays substantially intact upon impacting an object. For example, the rear unit 30 may have a substantially solid construction or configuration of material and is separate and discrete from the front unit 60. Alternatively, the rear unit 30 may have a hollow construction.

As shown in FIG. 1A, an exemplary embodiment of a front unit 60 may have a front conical section ("front section," "fragmented section") 62 and a rear portion ("cavity wall," "rear section")64, wherein the rear portion 64 may be configured as a cavity wall structure extending rearward from the shelf 45 of front conical end 62. The front unit 60 may have an open end ("receiving end") 84, which may receive the rear unit 30, as disclosed hereinafter. It should be understood that the front conical end 62 can be produced by any method and process understood by a person of ordinary skill in the art (POSITA) including exemplary embodiments, as non-limiting examples only, disclosed extensively by the inventor in a previously issued patent, U.S. Pat. No. 8,307,768 dated Nov. 13, 2012. Accordingly, the front conical end 62 of front unit 60 will only be discussed when needed for context of the balance of the invention.

As shown in FIG. 1B, the front unit 60 may have a crumpled section 72, which is a continuous body disposed between the front conical section 62 and the rear section 64. Additionally, the front conical section 62 may have an internal surface 43, which may have a similar configuration to the end portion 42, as disclosed in greater detail hereinafter.

Also shown in FIG. 1B, an exemplary embodiment of a rear unit 30 may comprise a rim portion ("first portion") 37, a middle portion ("second portion") 32, and an interior portion ("third portion") 40, wherein the middle portion 32 extends frontwards from the rear shelf 38 and the interior portion extends frontwards from the front shelf 34. Additionally, the exemplary middle portion 32 includes an outer surface 36 that extends rearwards from front shelf 34 to a rear shelf 38. An exemplary shelf 38 may be configured as a structural portion of rim 37. An exemplary rim may be configured to have a greater diameter than middle portion 32. It should be understood that the outer surface 36 of exterior portion 32 can include any configuration along a vertical cross section represented by the sectional line 71-71. As an example, the configuration may be a circular configuration wherein middle portion 32 comprises a cylindrical outer surface 36. Similarly, the rim portion 37 can include any configuration along a vertical cross section 71-71, for example, a circular configuration wherein rim portion 37 comprises a cylindrical outer surface. In one embodiment, as shown by FIGS. 1*a-c*, the rim portion 37 may have the same cylindrical configuration as the middle portion 32, wherein the rim portion 37 has a larger diameter than the middle portion 32. Alternatively, the rim portion 37 may have a different configuration as the middle portion 32.

One of various exemplary embodiments of the rear unit 30 comprises a single structure or single mass of material wherein interior portion 40 is integral with middle portion 32. Alternatively, another exemplary embodiment of the rear unit 30 includes interior portion 40 being a separate and discrete structure that is secured to middle portion 32, such as being secured at the front shelf 34.

One of the various exemplary embodiments of the rear unit 30 has interior portion 40 which is centered on and extends axially from front shelf 34. It should be understood that interior portion 40 can have any vertical cross-sectional 71-71 configuration, for example, a circular configuration.

As shown by the exemplary embodiment in FIG. 1B, interior portion 40 can be configured to have a majority of the interior portion 40 structure extend into the front conical end 62 of the front unit 60. In another exemplary embodiment, the interior portion 40 is configured to have at least a portion extend, for example, partially into the front conical end 62 of the front unit 60.

As an example, the interior portion 40 or rear unit 30 may have an end portion 42. It should be understood that end portion 42 can comprise any configuration, for example, a square, rectangle, cylinder, sphere, pyramid, tetrahedron, prism, planar, convex or concave, and any combination of such configurations. It should be understood that interior portion 40 can be formed without end portion 42, thus leaving front wall 34 as a front-most portion of rear until 30.

It should be understood that, as an example, the front unit 60 and rear unit 30 may be constructed such that the units 60, 30 are complimentary and fit together snugly when assembled, as disclosed hereinbelow. Additionally, it should be understood that the front unit 60 and rear unit 30 may be constructed from various materials, such as copper lead, steel, polymer, etc. Additionally, it should be understood that the front unit 60 and rear unit 30 may both be constructed from the same material or may be constructed from different materials. As an example, the front unit 60 may be made from copper and the rear unit 30 may be made from bronze.

Additionally, the exemplary non-limiting method to form the crumpled section 72, and before a force is provided on the wall 34 rear unit 30. The exemplary ADIB 10 may be assembled as shown in FIGS. 1B-C. As shown, the rear unit 30 may be inserted through the receiving end 84 of front unit 60 along direction 85 through the receiving end 84. Then, the front unit 60 and rear unit 30 may be pressed together until the front shelf 34 of the rear unit 30 engages the crumpled section 72 and the crumpled section 72 is converted into a ring separation structure 80, which is a continuous body disposed between the fragmented section 62 and cavity wall section 64 of the front unit. The angled ring separation structure ("u-shaped separation ring," "separation ring," "angled separation ring") 80 allows for the timely, controlled separation between the front unit 60 and rear unit 30, as disclosed in greater detail herein.

As shown in FIG. 1C, after the front unit 60 receives the rear unit 30 and the exemplary ADIB 10 is assembled, the receiving end 84 may be occupied by the rear rim 37 and the rear wall 68 of the cavity wall section 64 may be flush with the rear shelf 38 of the rear rim 37. For one exemplary embodiment, the rear rim 37 of the rear unit 30 may establish the rearmost structure of the projectile 10. Additionally, in this exemplary embodiment, the inner surface 43 of the front conical section 62 may have a configuration to receive the end portion 42 of the interior portion 40 such that the inner surface 43 fits snugly, for example small tolerances, with the end portion 42.

As described herein, the ADIB 10 having a front unit and a rear unit, the front unit adapted to house the rear unit is provided. The front unit 60 has a fragmented section 62, a cavity wall section 64, a separation ring 80, and a plurality of fragments 63, 65. The separation ring 80 may be angled forward or rearward with respect to the center of the bullet or with respect to the outermost edge of the bullet. Additionally, the separation ring 80 is disposed on the front unit 60 between the fragmented section 62 and the cavity wall section 64 and each of the plurality of fragments 63, 65 is adapted to attach to the separation ring 80. Furthermore, the fragmented section 62 of the front unit 60 may be a conical shape.

Figure 2A:
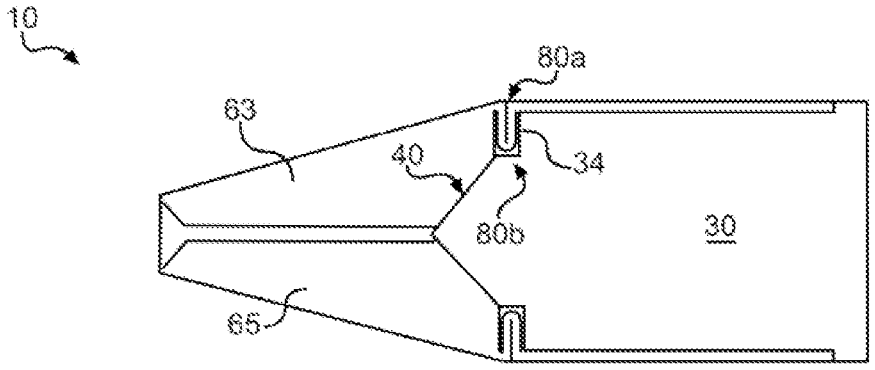
FIGS. 2A-B illustrate horizontal cross-sectional views showing fragment detachment of an exemplary embodiment of an ADIB, according to an aspect.
Figure 2B:
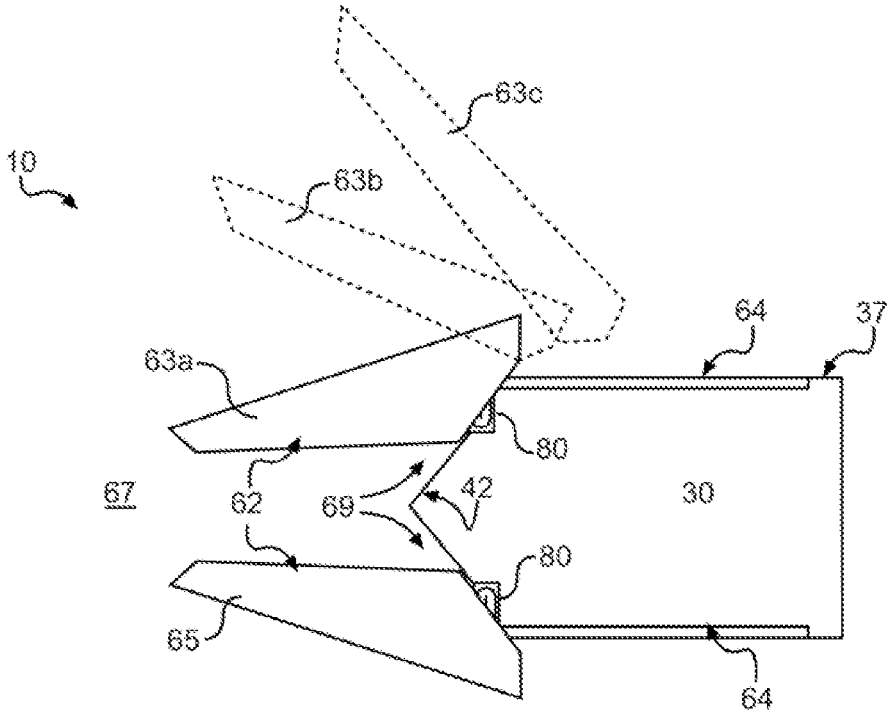

FIGS. 2A-B illustrate horizontal cross sectional views showing fragment ("plurality of fragments") 63, 65 detachment of an exemplary embodiment of a ADIB 10, according to an aspect. FIG. 2A illustrates an exemplary projectile 10 after being ejected and before contacting an object. As shown, the projectile 10 is intact prior to contacting an object, i.e., the front unit 60 and rear unit 30 have not separated and the fragments 63, 65 have not detached. As shown, the outer diameter 80*a* of the separation ring structure may be equal to the outside diameter of the bullet and an inside diameter 80*b* which corresponds to the diameter of an interior portion 40 of the rear unit 30 where the interior portion 70 starts at a shelf 34.

FIG. 2B illustrates the reaction of the projectile 10 upon contact with an object, such as an animal. As shown in FIG. 2B, the front conical end 62 of the front unit 60 may be configured such that the front conical end 62 separates in a timely, controlled manner from the rear unit 30 in a plurality of fragments 63,65 upon contact with an object. In this view only two fragments 63, 65 are shown. However, it should be understood that any number of fragments can be provided in the front conical end 62 if front unit 60 to split off from projectile 10.

As disclosed hereinbefore, the rear unit 30 may be configured such that it remains substantially intact upon impacting an object while the front unit 60 may be configured to fracture and separate from the rear unit 30 upon impacting an object. Such a design is important to, for example, permanently incapacitate an animal quickly by maximizing both trauma shock and hydro shock. Yet another benefit may be deformation of the end portion 42 of the rear unit 30, which may be substantially prevented by efficient separation of the fragments from the rear unit 30.

Upon impacting an object, frontmost end 67 of projectile 10 may first contact an object. As the projectile 10 contacts the target, the larger mass of the rear unit 30 relative to the front unit 60 may drive end portion 42 of rear unit 30 through the front conical section 62, thus splitting the front conical section 62 into fragments 63, 65. As an example shown in FIG. 2*b*, if a projectile is configured with a conically shaped end portion 42, then the fragments 63, 65 may slide along the surface of the conical formation of the end portion 42 in directions 69. As the fragments 63, 65 slide, they may slice through the ring separation structure 80 and ultimately rotate in a clockwise motion away from the frontmost end 67 of the projectile 10.

Such a clockwise motion is illustrated by the progression of fragment 63 shown in FIGS. 2*a*-2*b*. Before the projectile 10 impacts an object, an exemplary position of fragment 63 is shown in FIG. 2*a*. As the projectile 10 impacts an object, the fragment 63*a* may firstly slide outward along the end portion 42 in the direct 69 until the separation ring 80 is severed. Then secondly, the fragment 63*b* may begin to rotate clockwise with respect to the frontmost end 67. Lastly, the fragment 63*c* may continue the same clockwise rotation until it is embedded into an object.

It should be noted that the angled construction of the ring separation structure 80 facilitates the break-away of the fragments 63,65 from the projectile 10, such that the break-away is very fast and controlled.

Figure 3:
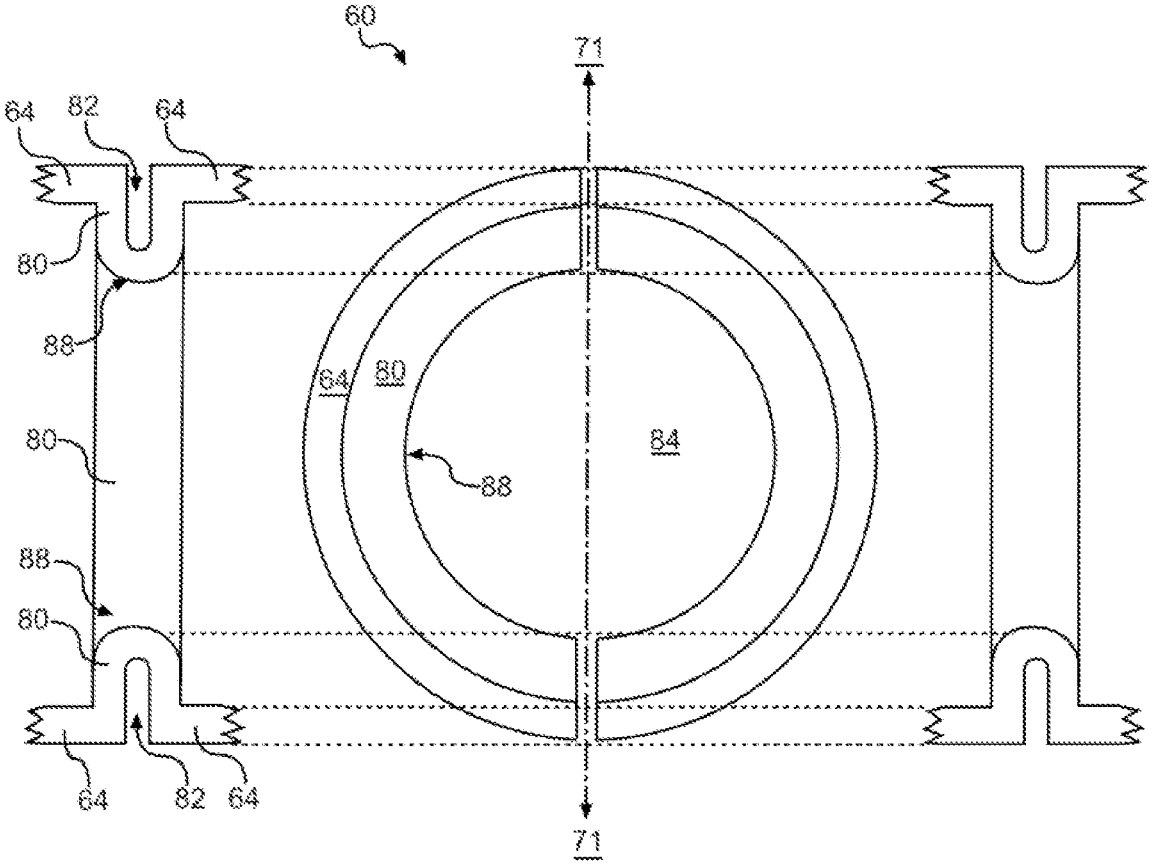
FIG. 3 illustrates a rear view of an exemplary embodiment of front unit and a vertical cross-sectional view of the angled separation structure, according to an aspect.

FIG. 3 illustrates a rear view of exemplary embodiment of front unit 60 and a vertical cross-sectional view of the angled separation structure 80, according to an aspect. A triple circular structure is shown representing the front unit 60 as seen through the receiving end 84 of the front unit 60 after the ring separation structure 80 is formed. It should be noted that, for clarity, the drawing is shown without rear unit 30 and without the structure of the front conical end 62 being shown. To the left and right of the triple circular structure is a vertical cross-sectional view of the triple circular structure along the line 71-71. From this view of the triple circular structure, the central circle is an opening from the receiving end 84 of the front unit 60. The circle surrounding the central circle represents the ring separation structure 80 and the circle surrounding the ring separation structure 80 is the cylindrical hollow structure of the cavity wall section 64 and the other side is connected to the fragmented portion of the front unit 60.

As shown to the left and right of FIG. 3, the ring separation structure 80 is shown generally as a u-shaped structure with slot 82 and curved innermost most segment 88. While this is one exemplary embodiment of the invention, this configuration is shown for simplicity of discussion. In another exemplary embodiment of the ring separation structure 80, the slot 82 may be effectively closed with the opposite sides of the slot 82 adjacent or flush. Alternatively, in another exemplary embodiment of the ring separation structure 80, the slot 82 may be at least partially closed with at least portions of the opposite sides of the slot 82 adjacent or flush.

Figure 4:
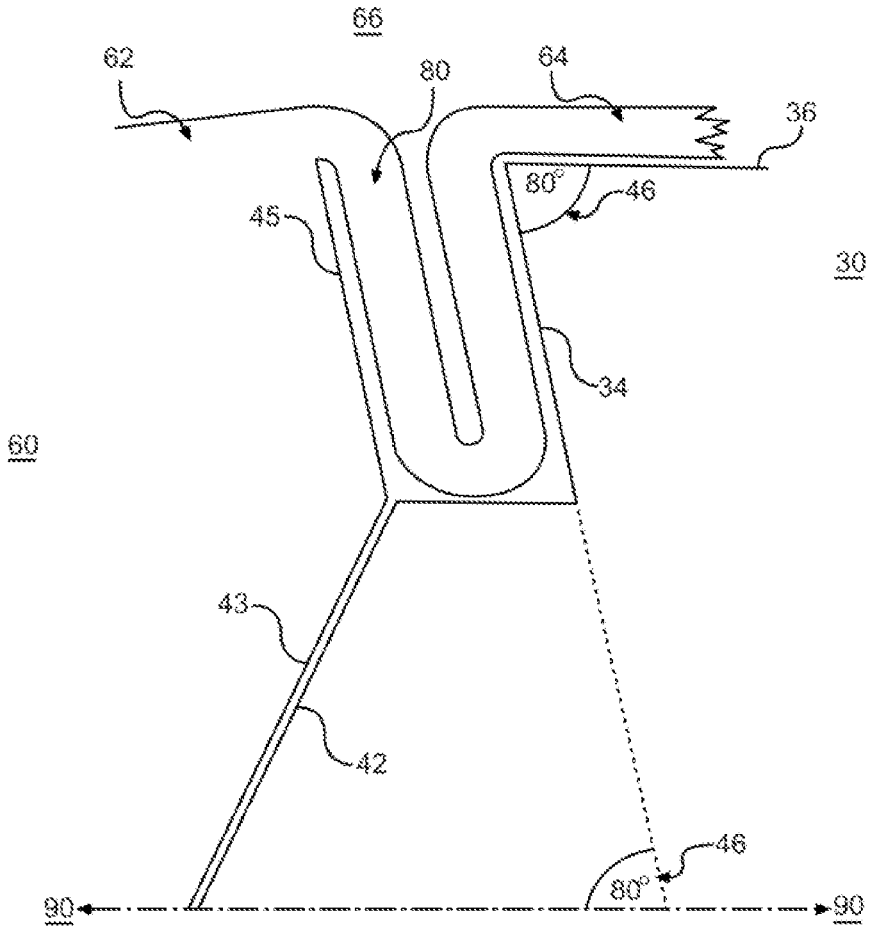
FIG. 4 illustrates a close up horizontal cross-sectional view of an exemplary embodiment of the angled separation ring, according to an aspect.

FIG. 4 illustrates a close up horizontal cross-sectional view of an exemplary embodiment of the angled separation ring 80, according to an aspect. As an example, FIG. 4 illustrates a close-up view of the angled separation ring 80 formed by an assembled front 60 and rear unit 30, as shown in FIG. 1*c*. In an exemplary embodiment, the separation ring structure 80 is angled rearwards from the front of the projectile 10 towards the center of the bullet represented by the horizontal sectional line 90-90, thus facilitating the efficient break-away of the fragments 63, 65 from the projectile 10. In other words, the separation ring 80 is angled forward or rearward with respect to the center of the bullet 90-90 or rearward with respect to the outermost edge 66 of the projectile 10. As an example, a rearwards angle 46 between 70° and 80° is recommended to achieve efficient break-away.

As an example, the inner shelf 45 of the front unit 60, front shelf 34 of rear unit 30, and the separation ring 80 angled are parallel to each other, such that they are all angled rearwards from the front of the projectile 10 towards the center of the bullet 90-90. Additionally, to further facilitate efficient break-away of the fragments 63, 65, it is recommended to angle the internal surface 43 of the front unit 60 and the end portion 42 of the rear unit 30, which may be parallel, frontwards from the rear of the projectile 10 towards the center 90-90.

Figure 5:
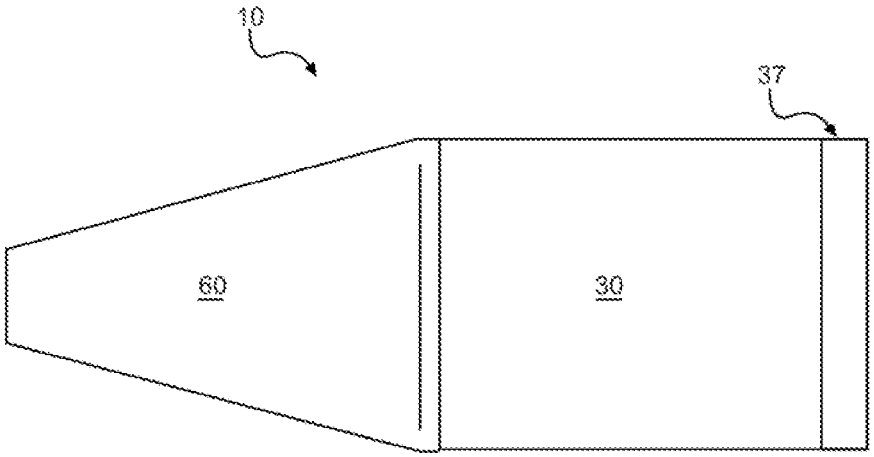
FIG. 5 illustrates a side view of an exemplary embodiment of an ADIB, according to an aspect.

FIG. 5 illustrates a side view of an exemplary embodiment of a ADIB 10, according to an aspect. As disclosed hereinabove, an exemplary assembled projectile 10 may comprise a front unit 60 and a rear unit 30, wherein the rear rim portion 37 may establish the rearmost portion of the projectile 10. It should be noted that, in this exemplary embodiment, the assembled ADIB 10 does not require a bullet jacket.

Figure 6A:
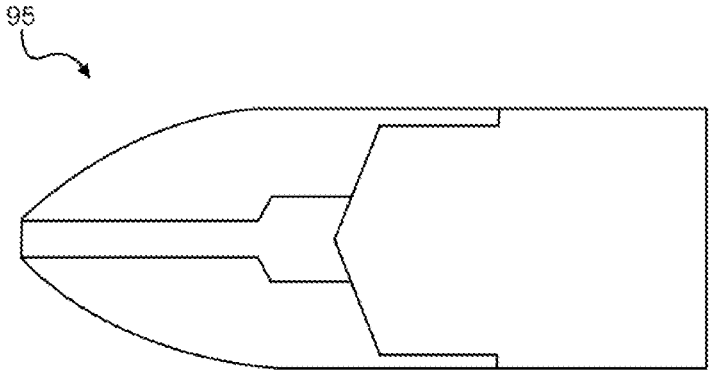
FIGS. 6A-B illustrate horizontal cross-sectional views comparing an exemplary embodiment of a Dual Impact Bullet (DIB) to an exemplary embodiment of an ADIB, according to an aspect.
Figure 6B:
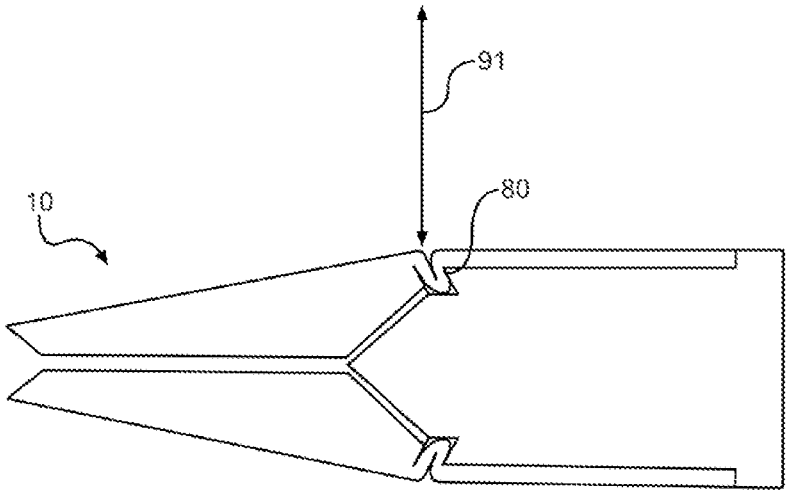

FIGS. 6A-B illustrate horizontal cross-sectional views comparing an exemplary embodiment of a Dual Impact Bullet (DIB) 95, as disclosed in U.S. Pat. No. 8,307,768, titled "Projectiles and Method to Forming Projectiles", to an exemplary embodiment of a ADIB 10, according to an aspect.

By the line 91, the design of the DIB 95 does not include an angled separation ring 80, while the design of the ADIB 10 does. The design of the ADIB 10 improves upon the design of the DIB 95 by including an angled separation ring 80, which provides for faster and more efficient separation of the fragments, resulting is shallow fragment penetration on an object. Thus, the DIB 95 and ADIB 10 provide different functions upon impacting an object.

It may be advantageous to set forth definitions of certain words and phrases used in this patent document. The term "couple" and its derivatives refer to any direct or indirect communication between two or more elements, whether or not those elements are in physical contact with one another. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Further, as used in this application, "plurality" means two or more. A "set" of items may include one or more of such items. Whether in the written description or the claims, the terms "comprising," "including," "carrying," "having," "containing," "involving," and the like are to be understood to be open-ended, i.e., to mean including but not limited to. Only the transitional phrases "consisting of" and "consisting essentially of," respectively, are closed or semi-closed transitional phrases with respect to claims.

If present, use of ordinal terms such as "first," "second," "third," etc., in the claims to modify a claim element does not by itself connote any priority, precedence or order of one claim element over another or the temporal order in which acts of a method are performed. These terms are used merely as labels to distinguish one claim element having a certain name from another element having a same name (but for use of the ordinal term) to distinguish the claim elements. As used in this application, "and/or" means that the listed items are alternatives, but the alternatives also include any combination of the listed items.

Throughout this description, the aspects, embodiments or examples shown should be considered as exemplars, rather than limitations on the apparatus or procedures disclosed or claimed. Although some of the examples may involve specific combinations of method acts or system elements, it should be understood that those acts and those elements may be combined in other ways to accomplish the same objectives.

Acts, elements and features discussed only in connection with one aspect, embodiment or example are not intended to be excluded from a similar role(s) in other aspects, embodiments or examples.

Aspects, embodiments or examples of the invention may be described as processes, which are usually depicted using a flowchart, a flow diagram, a structure diagram, or a block diagram. Although a flowchart may depict the operations as a sequential process, many of the operations can be performed in parallel or concurrently. In addition, the order of the operations may be re-arranged. With regard to flowcharts, it should be understood that additional and fewer steps may be taken, and the steps as shown may be combined or further refined to achieve the described methods.

If means-plus-function limitations are recited in the claims, the means are not intended to be limited to the means disclosed in this application for performing the recited function, but are intended to cover in scope any equivalent means, known now or later developed, for performing the recited function.

Claim limitations should be construed as means-plus-function limitations only if the claim recites the term "means" in association with a recited function.

If any presented, the claims directed to a method and/or process should not be limited to the performance of their steps in the order written, and one skilled in the art can readily appreciate that the sequences may be varied and still remain within the spirit and scope of the present invention.

Although aspects, embodiments and/or examples have been illustrated and described herein, someone of ordinary skills in the art will easily detect alternate of the same and/or equivalent variations, which may be capable of achieving the same results, and which may be substituted for the aspects, embodiments and/or examples illustrated and described herein, without departing from the scope of the invention. Therefore, the scope of this application is intended to cover such alternate aspects, embodiments and/or examples. Hence, the scope of the invention is defined by the accompanying claims and their equivalents. Further, each and every claim is incorporated as further disclosure into the specification.

What is claimed is:

1. A bullet having a U-shaped angled separation ring being disposed between a fragmentable section of a front unit and a cavity wall of the front unit, the U-shaped angled separation ring being adjacent to a rear unit, the front unit having an inner shelf, and comprising the cavity wall, wherein the cavity wall is continuous, extending rearward from the inner shelf, wherein the cavity wall is at least partially hollow, the rear unit being configured to be secured to the front unit to form the bullet, and the rear unit having a front shelf and a rear shelf, wherein the inner shelf, the front shelf, and the rear shelf are at the same angle and thus each of the inner shelf, the front shelf, and the rear shelf are parallel to each other, and wherein the U-shaped angled separation ring is a continuous body formed from the cavity wall, by a crumpled section of the front unit being fully compressed.

2. The bullet of claim 1, wherein the U-shaped angled separation ring is an interior ring disposed in the bullet and an outer circumference of the U-shaped separation ring is angled forward from a lengthwise axis of the bullet.

3. The bullet of claim 2, wherein the forward angle is between 70° and 80°.

4. The bullet of claim 1, wherein the U-shaped angled separation ring is an interior ring disposed in the bullet an outer circumference of the U-shaped separation ring is angled rearward from a lengthwise axis of the bullet.

5. The bullet of claim 4, wherein the rearward angle is between 70° and 80°.

6. The bullet of claim 1, wherein the U-shaped angled separation ring is continuous from a rear side of a fragmentable portion of the front unit.

7. The bullet of claim 1, wherein an outside diameter of the U-shaped angled separation ring is the same as an outside diameter of the bullet.

8. The bullet of claim 1, wherein the front unit has a conical end.

9. The bullet of claim 8, wherein an inside diameter of the U-shaped angled separation ring is the same as a diameter of a front most portion of the rear unit before the conical end.

10. The bullet of claim 1, wherein the U-shaped angled separation ring is disposed on the front unit between a front fragmentable section and a rear hollow cavity wall.

11. The bullet of claim 10, wherein the U-shaped angled separation ring has a continuous configuration and is adapted to connect the fragmentable section of the front unit to the cavity wall of the front unit.

12. The bullet of claim 1, wherein the U-shaped separation ring has an inside diameter which corresponds to a diameter of an interior portion of the rear unit where the interior portion starts at a shelf.

13. A bullet comprising:

a front unit and a rear unit, the front unit adapted to house and secure to the rear unit;

the front unit having a fragmentable section, a hollow cavity wall, and a U-shaped separation ring, wherein the U-shaped separation ring is disposed between the fragmentable section and the cavity wall; and an outer circumference of the U-shaped separation ring being angled forward with respect to a longitudinal axis through the center of the bullet.

14. The bullet of claim 13, wherein a front section of the front unit is conically shaped.

15. The bullet of claim 13, wherein the U-shaped separation ring is disposed at a transition between the front unit and the rear unit when the front unit and the rear unit are secured together.

16. The bullet of claim 13, wherein the U-shaped separation ring is a crumpled section adapted to form the U-shape when the front unit and the rear unit are secured together.

17. The bullet of claim 13, wherein the forward angle is between 70° and 80°.

18. A bullet comprising:

a front unit and a rear unit, the front unit adapted to house and secure to the rear unit;

the front unit having a fragmentable section, a hollow cavity wall, a U-shaped angled separation ring, wherein the U-shaped angled separation ring is disposed between the fragmentable section and the cavity wall; and an outer circumference of the separation ring being angled forward with respect to a longitudinal axis through the center of the bullet.

* * * * *